US005357776A

United States Patent [19]

Duran

[11] Patent Number: 5,357,776

[45] Date of Patent: Oct. 25, 1994

[54] METHOD OF FORMING BUSHING RINGS

[75] Inventor: John A. Duran, Glendora, Calif.

[73] Assignee: Avibank Mfg., Inc., Burbank, Calif.

[21] Appl. No.: 78,756

[22] Filed: Jun. 16, 1993

[51] Int. Cl.[5] ..... B21C 1/00; B21F 45/00

[52] U.S. Cl. ..... 72/275; 140/88; 411/33; 29/898.056

[58] Field of Search ..... 72/274–276, 72/467; 470/162, 163; 411/32, 33, 60, 61, 54, 55; 29/898.056, 898.054, 888.073, 898.057, 898.058; 140/88

[56] References Cited

U.S. PATENT DOCUMENTS

| | | | |
|---|---|---|---|
| 1,760,558 | 5/1930 | Klocke | 29/898.057 |
| 2,280,670 | 6/1942 | McCullough | 29/898.054 |
| 2,734,749 | 2/1956 | Benjamin | 411/33 |
| 2,830,485 | 4/1958 | Macy | 411/60 |
| 2,883,738 | 4/1959 | Morrow | 29/898.056 |
| 3,192,820 | 7/1965 | Pitzer | 411/33 |
| 4,285,084 | 8/1981 | Brady | 140/88 |
| 5,193,956 | 3/1993 | Duran | 411/33 |

FOREIGN PATENT DOCUMENTS

| | | | |
|---|---|---|---|
| 158846 | 12/1980 | Japan | 140/88 |
| 108672 | 8/1917 | United Kingdom | 29/898.054 |

*Primary Examiner*—Daniel C. Crane
*Attorney, Agent, or Firm*—Poms, Smith, Lande & Rose

[57] ABSTRACT

A method of forming adjustable bushing rings comprising the steps of drawing wire of round cross-section and predetermined diameter through a die forming said drawn wire in a wire having a generally trapezoidally-shaped cross-section. The drawn wire is cut into segments and these segments are bent about a rigid cylindrical form of a predetermined diameter until the elongated sides of said drawn wire are adjacent but spaced from each other a predetermined distance forming bushing rings.

8 Claims, 2 Drawing Sheets

FIG. 1
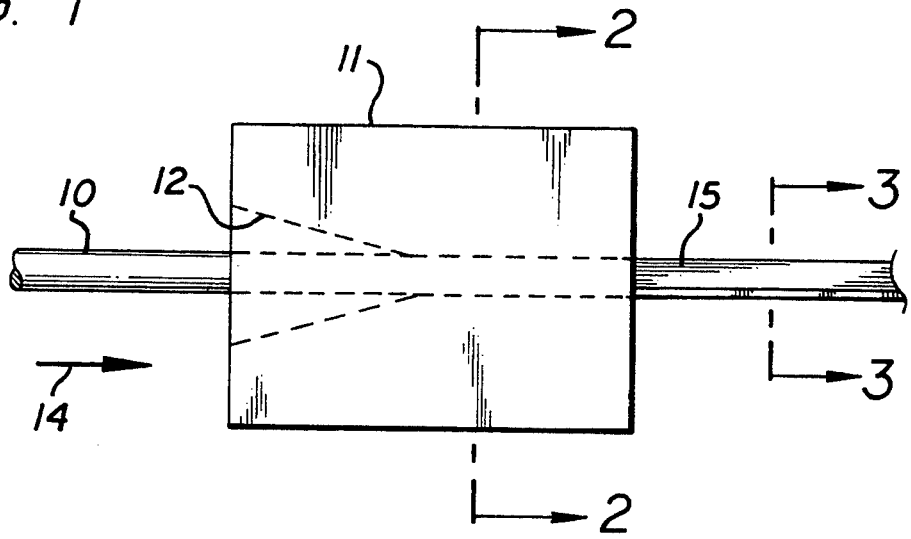
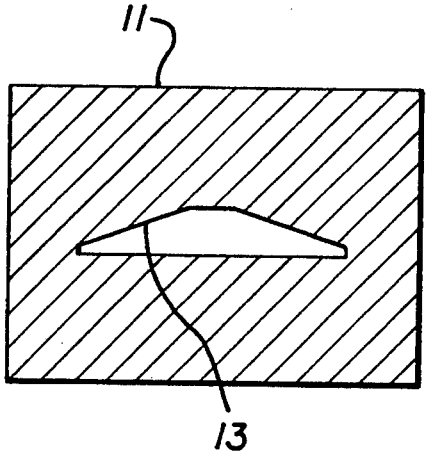
FIG. 2
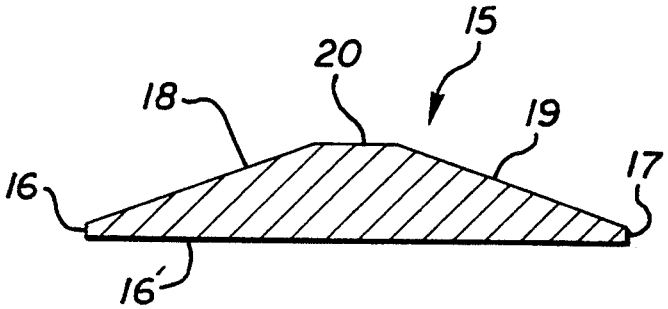
FIG. 3
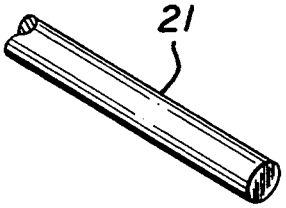
FIG. 4

FIG. 5
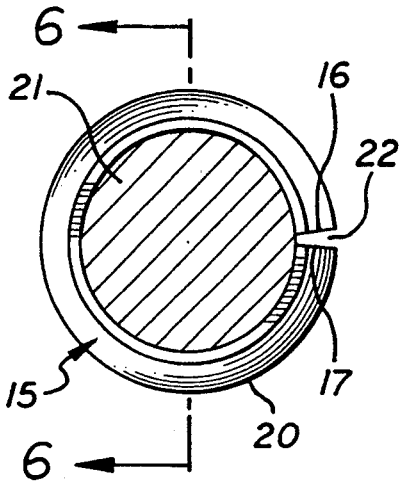
FIG. 6
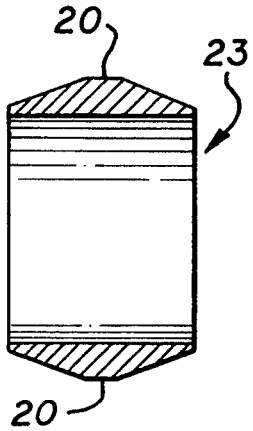
FIG. 7
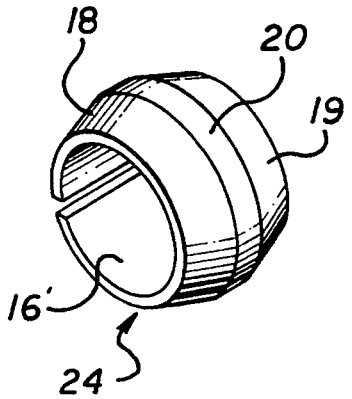
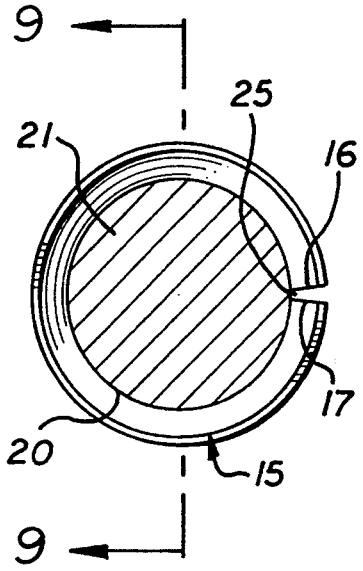
FIG. 8
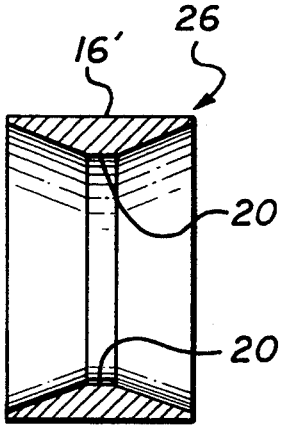
FIG. 9
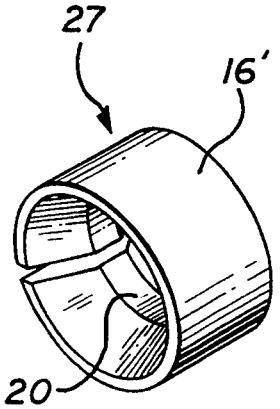
FIG. 10
FIG. 11
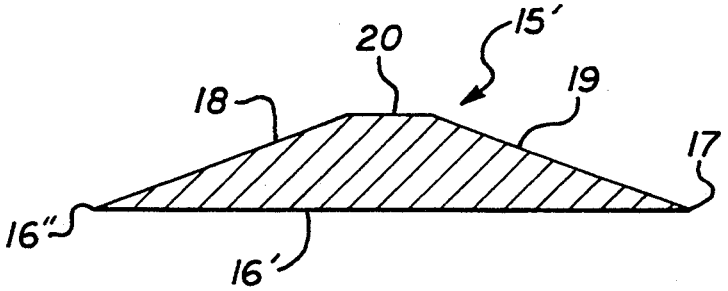

METHOD OF FORMING BUSHING RINGS

BACKGROUND OF THE INVENTION

1. Field of the Invention

The invention relates to bushing rings; and, more particularly, to a method of forming bushing rings which encircle the shank for a bolt and allow the bolt to be disposed in a hole where the overall diameter of the bolt can be adjusted.

2. Description of the Prior Art

Bushing segments or rings are known in the art which are used to encircle a bolt shank to fill the spacing between the bolt shank and the hole in walls of a panel in which the bolt is installed. These bushing segments are thus adjustable between the bolt shank and hole and such segments are disclosed in U.S. Pat. No. 3,192,820 to Pitzer. In U.S. Pat. No. 3,192,820 to Pitzer, there is disclosed a quick release pin having a plurality of male and female rings or bushings which, when compressed axially as a result of a compressive force applied to one end of the bushings, forces male rings to contract and the female rings to expand to assume a larger diameter. That is, the effective diameter of this quick release pin can be increased after the pin is installed in a hole or opening in an installation. In like manner, the effective diameter of the pin can be reduced (or returned to its original diameter) when it is desired to remove the pin from the installation.

In my U.S. Pat. No. 5,193,956, commonly assigned, there is disclosed a self-retaining adjustable diameter bolt having an adjustable nut including a bolt having a head, a shank, and a threaded end adapted to be inserted into a hole in an installation for subsequent coupling to a nut assembly. The bolt includes a pawl with a plurality of bushing segments mounted on the bolt shank, the pawl extending through an opening in the bolt adapted to engage the segments to stop withdrawal from the bolt. The nut assembly has a first portion threaded onto the threaded end driving the segments forward and filling the spacing between the hole and bolt shank. The nut assembly includes a second portion rotatable on the first portion which can be tightened against the panel installation. In this manner, full radial expansion of the segments takes place before the first nut portion bottoms out against the installation and the second nut portion can be then tightened against the installation.

The bushing segments used in the assembly disclosed in U.S. Pat. No. 5,193,956 requires both female-type and male-type bushing rings or segments. These rings or segments must be carefully manufactured to predetermined tolerances. The spacing between the split ring ends must be carefully slotted or machined. There is much waste of the inner material of such segments. Known manufacturing processes for forming such rings or segments are expensive, time consuming, and result in much material waste. There is a need for a method of forming such rings or segments inexpensively, quickly, and with little waste.

SUMMARY OF THE INVENTION

It is an object of this invention to provide a method for forming bushing rings or segments.

It is a further object of this method to carry out the foregoing object wherein the rings or segments so formed are either male-type or female-type rings or segments.

It is still another object of this invention to provide a method for forming bushing rings or segments wherein the necessary inventory for male-type and female--type rings or segments can be reduced.

These and other objects are preferably accomplished by the steps of drawing wire of round cross-section and predetermined diameter through a die forming said drawn wire in a wire having a generally trapezoidally-shaped cross-section. The drawn wire is then bent about a rigid cylindrical form of a predetermined diameter until the elongated sides of said drawn wire are adjacent but spaced from each other a predetermined distance Subsequently, the bent drawn wire is cut into segments of predetermined lengths.

Male-type or female-type bushing segments can be so formed.

BRIEF DESCRIPTION OF THE DRAWING

FIG. 1 is an elevational view illustrating the cold drawing of a wire through a die in accordance with the teachings of the invention;

FIG. 2 is a view taken along lines 2—2 of FIG. 1;

FIG. 3 is a view taken along lines 3—3 of FIG. 1;

FIG. 4 is a perspective view of a cylindrical form used in accordance with the teachings of the invention;

FIG. 5 is an elevational sectional view combining the wire form of FIG. 3 with the form of FIG. 4 illustrating one step in the formation of male-type bushing segments in accordance with the teachings of the invention;

FIG. 6 is a view taken along lines 6—6 of FIG. 5, the form being omitted for convenience of illustration;

FIG. 7 is a perspective view of a male-type bushing segment formed in accordance with the teachings of the invention;

FIG. 8 is an elevational sectional view combining the wire form of FIG. 3 with the form of FIG. 4 illustrating the one step in the formation of female-type bushing segments in accordance with the teachings of the invention;

FIG. 9 is a view taken along lines 9—9 of FIG. 8, the form being omitted for convenience of illustration;

FIG. 10 is a perspective view of a female-type bushing segment formed in accordance with the teachings of the invention; and FIG. 11 is a view similar to FIG. 3 showing a modification thereof.

DESCRIPTION OF THE PREFERRED EMBODIMENT

Referring now to FIG. 1 of the drawing, a wire 10 of a predetermined length and diameter, round in cross-section, is shown being drawn through a die 11. Die 11 has a tapered opening 12, shown in dotted lines, leading into a trapezoidally shaped chamber 13 (see also FIG. 2). Thus, wire 10 is drawn in the direction of arrow 14 (FIG. 1) into opening 12 in die 11, then through chamber 13 therein, as is well known in the wire drawing art. Of course, instead of a single die, a plurality of successive dies of smaller and smaller thicknesses of chamber 13 may be used as also is well known in the cold wire drawing art.

The drawn wire (see wire portion 15 in FIG. 1) has the trapezoidally shaped cross-section shown in FIG. 3. Thus, wire portion 15 has a base 16', vertical spaced sides 16, 17 and tapered portions 18, 19 (portion 18 interconnecting side 16 to top or apex 20 and portion 19 interconnecting side 17 at top or apex 20). Top 20 is horizontal and parallel to base 16'. Wire portion 15 is of course of any suitable length.

A rigid cylindrical mandril or form 21 is shown in FIG. 4. If it is desired to form male-type bushing segments or rings, such as segments 39, 40 in U.S. Pat. No. 5,193,956, the wire portion 15 is cut into segments of a predetermined length along its length and these segments are bent about cylindrical form 21 as shown in FIG. 5 with base 16' abutting against form 21. As seen in FIG. 5, a spacing 22 is formed between sides 16, 17 of wire portion 15. The final formed male-type wire portion, now portion 23, is shown in cross-section in FIG. 6 (form 21 having been removed). As seen in FIG. 6, the apices 20 are toward the outside of male-type wire portion 15. These male-type bushing rings or segments 24 (FIG. 7) can be used in conjunction with the assembly shown in U.S. Pat. No. 5,193,956, or for any other suitable use calling for such bushing segments or rings.

If it is desired to form female-type bushing segments or rings, such as segments 42, 43, and 44 as shown in U.S. Pat. No. 5,193,956, a cut segment of wire portion 15 is bent about cylindrical form 21 as shown in FIG. 8 with apex 20 abutting against form 21. As seen in FIG. 8, a spacing 25 is formed between sides 16, 17 of wire portion 15. The final formed female-type wire portion, now portion 26, is shown in cross-section in FIG. 9 (form 21 having been removed). As seen in FIG. 9, the apices 20 are toward the inside of the female-type wire portion 15 and base 16' to the outside. These female-type bushing rings or segments 27 (FIG. 10) can be used in conjunction with the assembly shown in U.S. Pat. No. 5,193,956, or for any other suitable use calling for such bushing segments or rings.

Any suitable materials or dimensions may be used. For example, wire 10 may be stainless steel about 0.218 inches in diameter. Referring to FIG. 3, wire portion 15 may be about 0.3107 inches long, about 0.058 inches high (sides 16, 17 being about 0.010 inches high, and top or apex 20 being about 0.047 inches long). The angle of taper of sides 17, 18 may be about 20°.

Referring to FIG. 5, the formed bushing portion 15 may be about 0.492 to 0.495 inches in diameter and spacing 22 may be about 0.01 to 0.02 inches (varying outwardly from form 21). As seen in FIG. 7, bushing portion 23 may be about 0.3087 to 0.3127 inches wide and have an inner diameter of about 0.378 inches. The final segment 24 in FIG. 7 may be about 1.535 inches long.

As seen in FIG. 8, the formed wire portion 15 may be about 0.492 to 0.496 inches in diameter and spacing 25 varying from 0.01 inches to 0.02 inches outwardly from form 21. The formed female-type wire portion 26 in FIG. 9 may be about 0.3087 to 0.3127 inches wide with an inner diameter of about 0.378 inches. The final female-type bushing segment 27 in FIG. 10 may be about 1.535 inches long.

Although the formed wire 15 (FIG. 3) has been disclosed as of generally trapezoidally-shaped in cross-section, sides 18, 19 may taper to base 16' forming end walls 16, 17 that are relatively small in height (or even tapering to a point). Thus, the cross-section shown in FIG. 3 may be generally a truncated triangle. This is shown in FIG. 11 wherein like numerals refer to like parts of the embodiment of FIG. 3. Here, instead of sides or end walls 16, 17, the formed wire 15' has sides 18, 19 which extend to base 16' forming points 16'', 17'.

The formation of bushing segments 24, 27 in this manner reduces the cost of manufacture since the bushing segments can be inexpensively manufactured to predetermined tolerances. Waste of material is reduced since there is no loss of inner material in forming the segments.

The process of manufacturing the bushing segments disclosed herein is faster and allows standardization of parts. That is, the need for maintaining a large inventory of predetermined lengths of male-type and female-type bushing segments is eliminated.

Although a specific embodiment of the invention has been disclosed, variations thereof may occur to an artisan and the scope of the invention should be determined only by the scope of the appended claims.

I claim:

1. A method for forming adjustable bushing segments of predetermined length consisting of the steps of:

drawing an elongated resilient metallic wire having essentially a round diameter through a die cold forming said wire into an elongated wire portion having, in cross-section, an elongated base, an elongated top spaced from the base and extending generally parallel thereto, first side means interconnecting one elongated side of said base to one elongated side of said top, and second side means interconnecting the other elongated side of said base to the other elongated side of said top forming said top of a width less than the width of said base extending in a direction normal to the longitudinal axis of said wire portion;

cutting said wire portion at spaced locations along its longitudinal axis in a direction normal to the longitudinal axis of said wire portion into a plurality of portions;

bending one of said plurality of wire portions only about an elongate rigid cylindrical form while contacting the form until opposed cut ends of said one wire portion are contiguous but spaced from each other; and removing said bent wire portion from said form thereby forming a bushing segment.

2. The method of claim 1 wherein the step of bending said wire portion includes the step of bending said wire portion about said form until the opposed cut ends are spaced about 0.015 inches from each other.

3. The method of claim 1 wherein said step of drawing said wire includes the step of drawing a wire of stainless steel.

4. The method of claim 1 wherein the step of drawing said wire includes the step of drawing a round wire about 0.218 inches in diameter.

5. The method of claim 1 wherein the step of drawing said wire includes the step of drawing said wire through a die cold forming said wire into an elongated wire portion substantially trapezoidally-shaped in cross-section.

6. The method of claim 1 wherein the step of drawing said wire includes the step of drawing said wire through a die cold forming said wire into an elongated wire portion substantially truncated triangularly shaped in cross-section.

7. The method of claim 1 wherein the step of bending said wire portion about said form includes the step of disposing the base of said wire portion against said form prior to bending the same.

8. The method of claim 1 wherein the step of bending said wire portion about said form includes the step of disposing the top of said wire portion against said form prior to bending the same.

* * * * *